United States Patent [19]

Gotta

[11] 4,090,650

[45] May 23, 1978

[54] CANTEEN WITH A STRAW

[76] Inventor: Harold J. Gotta, 44 Cove La., Levittown, N.Y. 11756

[21] Appl. No.: 709,000

[22] Filed: Jul. 26, 1976

[51] Int. Cl.[2] ..... A45F 3/20; A45F 5/00

[52] U.S. Cl. ..... 224/5 W; 215/11 R

[58] Field of Search ..... 224/5 W, 5 R, 26 R, 224/5 H; 215/11 R, 307, 311, 313, 314, 229, 100; 239/33; 222/528, 529, 464, 475, 211; 220/3.1

[56] References Cited

U.S. PATENT DOCUMENTS

| | | | |
|---|---|---|---|
| 298,985 | 5/1884 | Kimball | 224/5 W UX |
| 828,891 | 8/1906 | Krueger | 220/3.1 |
| 1,650,764 | 11/1927 | Marin | 224/5 W |
| 2,432,132 | 12/1947 | Allen | 215/11 X |
| 2,700,484 | 1/1955 | Rathsprecher | 222/211 X |
| 2,760,664 | 8/1956 | D'Amico et al. | 215/11 R |
| 2,770,399 | 11/1956 | Gross | 222/475 X |
| 3,278,095 | 10/1966 | Johns | 222/528 X |
| 3,337,098 | 8/1967 | Johns | 222/528 X |
| 3,547,296 | 12/1970 | Greenberg | 222/464 X |

*Primary Examiner*—Trygve M. Blix
*Assistant Examiner*—Jerold Forsberg

[57] ABSTRACT

A canteen is provided with a drinking straw extending through the top of the screw cap of the canteen. The straw may be pushed substantially completely into the canteen when the straw is not used or it may be withdrawn from the canteen to a substantial length such that one may drink from the canteen without removing it, for example, from a belt. The screw cap and canteen neck are provided with cooperating elements which pinch the straw closed in the closed position of the cap.

11 Claims, 8 Drawing Figures

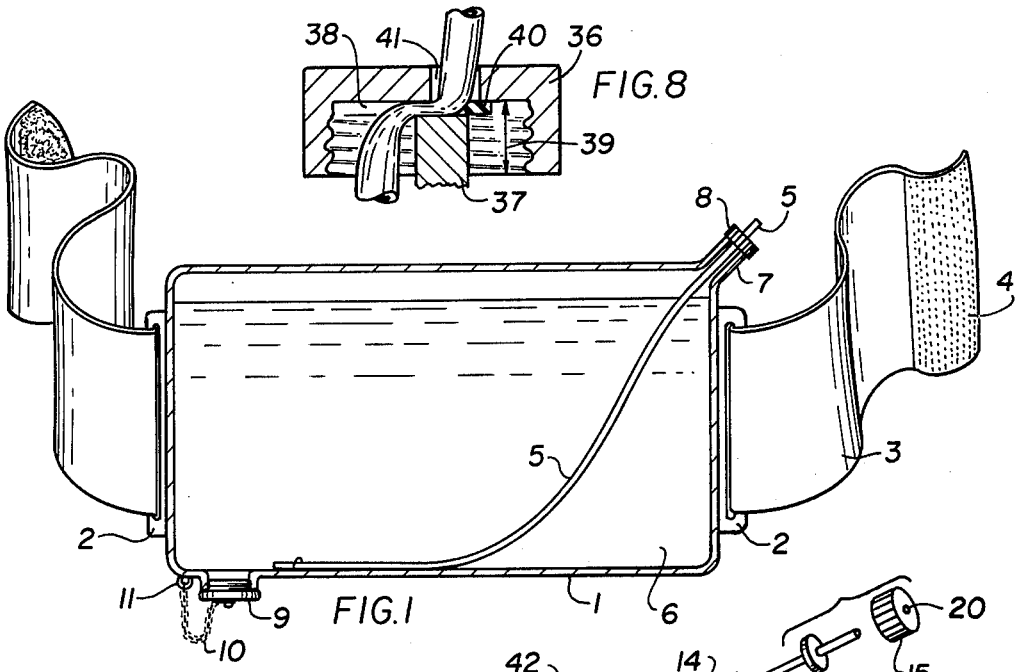
FIG.8
FIG.1
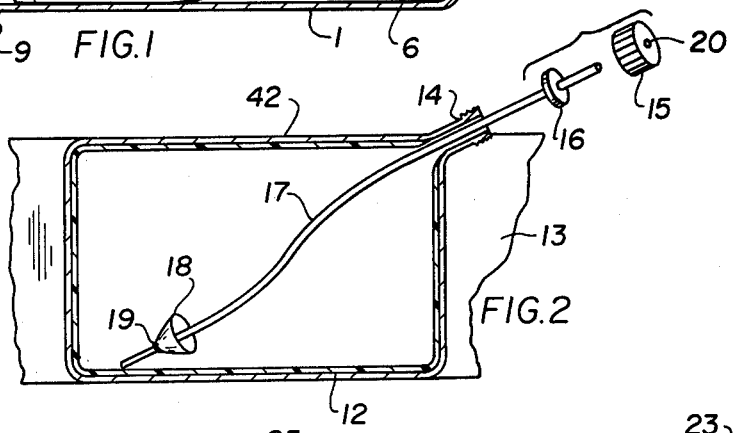
FIG.2
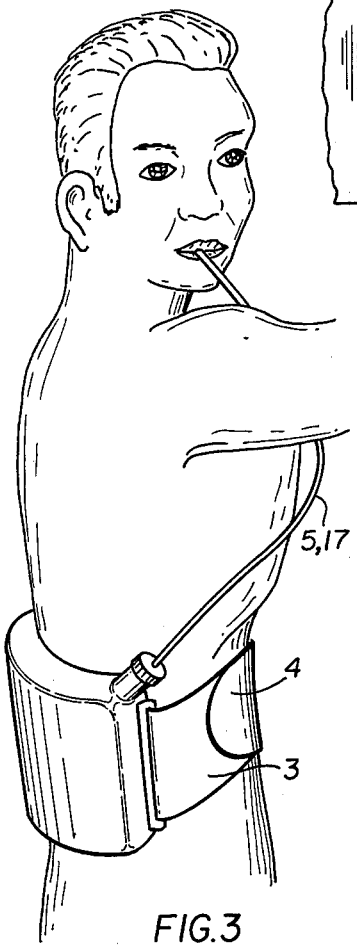
FIG.3
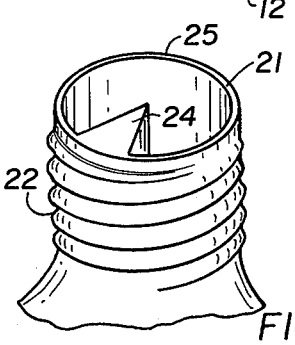
FIG.4
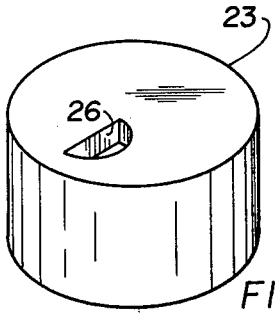
FIG.5
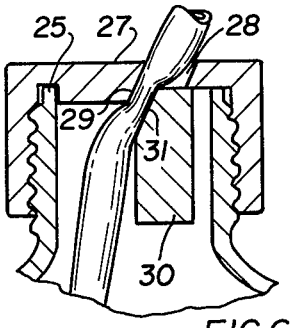
FIG.6
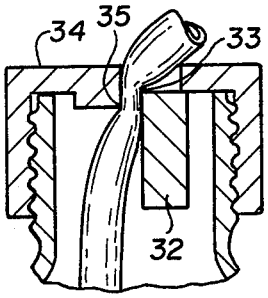
FIG.7

CANTEEN WITH A STRAW

BACKGROUND OF THE INVENTION

The present invention relates to a canteen with a straw, particularly a canteen which may be secured to a belt.

Various devices are known to facilitate the drinking of liquids from a container such as a canteen. For example, U.S. Pat. No. 3,843,032 which issued Oct. 22, 1974 discloses a canteen secured to a belt in a removable manner. If the user wants to drink, he must remove the canteen from the belt. U.S. Pat. No. 103,299 patented May 24, 1870 discloses a container provided with a "drinking tube" mechanically secured to the container in a removable fashion. The container must rest on a stationary surface in order to use the drinking tube.

U.S. Pat. No. 2,052,496 granted on Aug. 25, 1936, and U.S. Pat. No. 2,469,292 granted on May 3, 1949 both disclose drinking containers and means for securing the straw to the container, thus, in U.S. Pat. No. 2,052,496 a cup shaped container is provided with a closure member having a central hole therein through which a straw or tube extends into the container. No means are provided for closing the straw when it is not in use. Similar considerations apply to U.S. Pat. No. 2,469,292 in which the straw is merely held in a suitable position so that the user need not hold the straw. Both of these devices are not suitable for use as a canteen to be secured to a belt of the user.

U.S. Pat. No. 2,656,958 granted on Oct. 27, 1953 and U.S. Pat. No. 2,013,358 granted on Sept. 3, 1935 disclose various liquid containers in the form of a shoulder pack. The knapsack water bag of U.S. Pat. No. 2,013,358 is provided with a discharge hose 12 connected to the container through a closable valve. The valve is connected to an opening in the container separate from the filling opening.

OBJECTS OF THE INVENTION

In view of the foregoing it is the aim of the invention to achieve the following objects singly or in combination;

- to provide a convenience canteen which is suitable for many different purposes, for example, in hospitals or as part of a hunting outfit;
- to provide a canteen which may be easily secured to a belt or which itself may be formed as a belt having a liquid containing cavity therein;
- to provide a canteen with a straw extending through an opening in the closure means for the canteen which will automatically close the straw by pinching it when the closure means are in the canteen closing positions; and
- to provide a canteen with a straw which is suitable for mass production and which may be made of plastic materials thus avoiding the use of any metals.

SUMMARY OF THE INVENTION

According to the invention there is provided a canteen with a straw comprising a hollow body with an open neck closable by closure means having an opening therein through which a flexible straw extends. Straw pinching means are arranged so that the flexible straw is pinched into a closed condition when said closure means are in a canteen closing position.

In a preferred embodiment the canteen itself may be formed as a belt and the straw itself may have a substantial length to reach from the belt all the way to the user's mouth so that he may drink without moving his belt.

BRIEF FIGURE DESCRIPTION

In order that the invention may be clearly understood, it will now be described, by way of example, with reference to the accompanying drawings, wherein, FIG. 1 illustrates one embodiment of the present invention wherein the canteen may be secured to a belt, the canteen being shown in section;

FIG. 2 illustrates an embodiment of the invention in which the canteen and the belt form an integral structure;

FIG. 3 illustrates the use of the present invention;

FIG. 4 illustrates a perspective view of a threaded neck of the present canteen;

FIG. 5 illustrates a perspective view of a screw cap according to the invention;

FIG. 6 shows a sectional view through the neck and cap of one embodiment according to the invention;

FIG. 7 shows a view similar to that of FIG. 6, however, illustrating a further embodiment according to the invention; and FIG. 8 is a view similar to that of FIG. 6 and 7 but illustrating a further embodiment.

DETAILED DESCRIPTION OF PREFERRED EXAMPLE EMBODIMENTS

FIG. 1 shows one embodiment of the invention wherein the canteen 1 includes buckle means 2 through which a belt 3 may extend. The belt is preferrably provided with so called velcro closure elements 4. According to the invention a straw 5 reaches in to the space 6 inside the canteen 1 through a neck 7 closable by a closure cap 8, preferrably a threaded closure cap as will be described in more detail below.

The canteen 1 may be provided at its bottom with a further closure 9 secured by a chain 10 to a boss 11 protruding from the canteen 1. The closure 9 facilitates the cleaning of the canteen, however it is not essential to the present invention.

FIG. 2 shows a canteen 12 which forms an integral part of a belt 13. The neck 14 and the closure cap 15 of the embodiment according to FIG. 2 may be constructed in the same manner as in any of the other embodiments. A rubber washer 16 or the like is secured to the straw 17 outside of the canteen to prevent the straw from sliding or disappearing fully into the canteen. A similar device, such as a conical rubber washer 18 is secured to the opposite end of the straw 17 inside the canteen to prevent the straw from being fully pulled out of the canteen. The washer 18 is flexible so that it may be bent for pushing the washer into the canteens through the neck 14. Once the washer 18 passes the neck it flares outwardly and will thus not fit through the neck 14. Preferrably, the washer 18 is provided with a weight 19 which would tend to keep the lower end of the straw 17 at the bottom of the canteen.

The cap 15 is provided with an opening 20 through which the straw 17 extends when the cap 15 is secured to the neck 14.

FIG. 3 illustrates how the straw 5 or 17 may be pulled out of the canteen to a sufficient length to reach from the canteen all the way to the user's mouth without the need for removing the belt from the user's waist.

FIG. 4 illustrates on a somewhat enlarged scale the neck 21 of a canteen according to the invention. The neck is provided with an outer threading 22 for the screw cap 23 shown in FIG. 5. According to the invention the neck is provided with a straw pinching member 24 having a top surface preferrably level with the top edge 25 of the canteen neck. It will be appreciated, that the straw pinching member 24 may have a top surface somewhat above the upper edge 25 or somewhat below the upper edge 25 depending on the type of embodiment. The cap screw is provided with an opening 26 through which the straw extends.

The threading 22 has such a pitch that less than one full turn of the cap 23 will close the canteen completely while simultaneously pinching the straw into a closed position, thus, it is possible to drink from the canteen through the straw by just lightly turning the cap 23 in the opening direction to unpinch the straw but without completely removing the cap from the canteen.

FIG. 6 illustrates a vertical sectional view through one embodiment according to the invention wherein the cap 27 is provided with an opening 28 which is somewhat slanted relative to the vertical. At the lower end of the opening 28 the cap has an inwardly and downwardly facing shoulder 29. The pinching member 30 which forms preferably an integral part of the container neck has a slanted edge 31 facing upwardly and outwardly for cooperation with the shoulder 29 in pinching the straw into a closed position. Here again the threading will be so dimensioned that the inner surface of the cap 27 will touch the upper edge 25 of the canteen neck and the straw is pinched closed between the shoulder 29 and the slanted edge 31. Due to this feature and further due to the fact that the shoulder 29 and edge 31 overlap, the straw cannot be clipped off by the pinching.

FIG. 7 illustrates an embodiment similar to that of FIG. 6. However, in FIG. 7 the pinching member 32 has a square top edge 33 and the cap 34 has a square shoulder 35. The operation is substantially the same as that of FIG. 6.

In the embodiment of FIG. 8 the cap 36 and the pinching member 37 are so dimensioned that a small spacing 38 may be provided between the top surface of the pinching member 37 and the inwardly facing surface of the cap 36. This may, for example, be accomplished by dimensioning the depth 39 of the cap appropriately. In the embodiment of FIG. 8 the inner surface of the cap 36 overlaps the top surface of the pinching member 37 in the closed position of the cap in such a manner that the straw is sufficiently pinched between the overlapping surfaces. However, in order to properly seal the canteen a rubber washer or the like 40 may be provided at the top of the pinching member 37 or in a groove around the opening 41 in the cap 36. The washer 40 will have such an elastic yielding that it will permit the pinching of the straw on the hand and simultaneously assure the sealing of the canteen so that there may be no leakage through the opening 41.

With regard to all embodiments of the invention it will be appreciated, that the screw cap may have an outer threading and that the canteen neck may have an inner threading without departing from the gist of the invention. Further, all the elements of the present invention may be made from plastic materials readily available on the market. The straw will be sufficiently flexible for movement in and out of the canteen. The straw and canteen may, for example, be made of polyvinyl chloride or similar plastic material. Further, the canteen itself may be made of heat insulating material such as styrofoam. The styrofoam container may be secured in a holder of cloth or the like. In another embodiment the canteen may be made of plastic material lined with heat insulating material 42, or the canteen itself may be a so called Thermos (RTM) bottle.

Although the invention has been described with reference to specific example embodiments, it will be appreciated, that it is intended to cover all modifications and equivalents within the scope of the appended claims.

What is claimed is:

1. A canteen assembly comprising: canteen means including a hollow body for holding a drinkable liquid and a threaded open neck operatively connected to said body;

closure means comprising a screw cap for said open neck which is threadably receivable on said neck, said neck having threading for said screw cap, the screw cap being movable between an opening and closing position, said screw cap having an opening therein;

extendable and retractable flexible straw means extending through said opening in said closure means and into said hollow body, and straw means being movable between a withdrawn position in which a substantial portion thereof projects outwardly of said open neck and a retracted position in which said straw means is contained substantially within said body and neck;

straw pinching means disposed on said neck and closure means which cooperate to positively pinch said flexible straw means into a closed condition when said closure means is in a closed position and said straw means is in a retracted position;

said straw pinching means comprising a stationary member as part of said open neck, said stationary member having a top surface reaching into said open neck, and means for stopping the screw cap in a closed position so that its inner surface is juxtaposed proximate said top surface of said stationary member sufficiently to pinch said straw to close it; and belt means for securing said canteen means to the waist of a user.

2. The canteen according to claim 1, wherein said closure means comprise a screw cap, said neck including a threading for said screw cap, said straw pinching means having a shoulder as part of said screw cap, said shoulder extending inwardly adjacent to said opening in the screw cap, said straw pinching means further comprising a stationary member as part of said open neck, said stationary member reaching into said open neck.

3. The canteen according to claim 2, wherein said screw cap has a threading corresponding to said threading of said neck, said threadings having such a pitch that the canteen may be closed by turning the cap somewhat less than one full turn to simultaneously close the canteen and the straw by properly pinching the straw.

4. The canteen according to claim 2, wherein said neck and member have an upper edge, said shoulder inside said cap reaching toward a level which is lower than said upper edge of said neck and member when the cap is in the closed, straw pinching position.

5. The canteen according to claim 4, wherein said member and shoulder have square edges facing each other for pinching the straw.

6. The canteen according to claim 4, wherein said member and shoulder have slanted edges facing each other for pinching the straw.

7. The canteen according to claim 1, wherein said inner cap surface is slightly spaced from said top surface of said stationary member, and wherein sealing means are provided to seal said opening against said top surface of said stationary member.

8. The canteen according to claim 1, further comprising means secured to said straw inside said canteen proper for preventing the complete withdrawal of said straw from said canteen, and further means secured to said straw outside said canteen proper for preventing the straw from disappearing fully into said canteen.

9. The canteen according to claim 1, wherein said canteen and belt means form an integral structure.

10. The canteen according to claim 1, wherein said belt means comprise velcro closure means.

11. The canteen according to claim 1, wherein said hollow body is lined with heat insulating material.

* * * * *